US005762680A

United States Patent [19]

Holta et al.

[11] Patent Number: 5,762,680

[45] Date of Patent: Jun. 9, 1998

[54] DISTRIBUTION SYSTEM FOR MOLTEN MAGNESIUM

[75] Inventors: Olav Holta, Skien; Håkon Westengen, Porsgrunn, both of Norway

[73] Assignee: Norsk Hydro a.s., Oslo, Norway

[21] Appl. No.: 717,773

[22] Filed: Sep. 24, 1996

[30] Foreign Application Priority Data

Nov. 22, 1995 [NO] Norway ..... 954727

[51] Int. Cl.[6] ..... C22B 26/00

[52] U.S. Cl. ..... 75/600; 266/236

[58] Field of Search ..... 266/236; 222/591, 222/593; 75/600

[56] References Cited

U.S. PATENT DOCUMENTS 4,635,706 1/1987 Behrens ..... 222/591

*Primary Examiner*—Scott Kastler

*Attorney, Agent, or Firm*—Wenderoth, Lind & Ponack

[57] ABSTRACT

An apparatus for distribution of magnesium or magnesium alloys from a central melting unit (2) into a casting shop with one or more casting machines (3) has a tube furnace (1) extending from a central melting unit (2) into the casting shop. The tube furnace (1) is equipped with outlets (6) at the top for the mounting of a transfer tube (7) for the supply of metal to one or more holding furnaces (4) arranged at each casting machine. The tube furnace is preferably placed inside a steel cover (8) and is positioned just beneath the metal level in the holding furnace (4). The tube furnace (1) and transfer tubes (7) are provided with heating elements (11) with an outer insulation (12). The transfer tubes (7) have an air inlet (9). Two or more tube furnaces could be placed in the steel cover (8). The metal is transferred by the act of gravity.

11 Claims, 2 Drawing Sheets

DISTRIBUTION SYSTEM FOR MOLTEN MAGNESIUM

BACKGROUND OF THE INVENTION

The invention relates to a system for distribution of molten magnesium or magnesium alloys from a central melting unit to several casting machines, which would typically be high pressure die casting machines.

During melting of magnesium alloys in foundries, separate melting furnaces for each casting machine are commonly used. This is inconvenient since it demands an investment in several melting furnaces. It also requires space for and a system for transportation of ingot pallets to each casting machine. This transport is most often carried out by truck. In addition, the use of only one furnace at each casting station may cause quality variations due to considerable temperature fluctuations in the liquid metal transferred to the casting machine. To some extent this disadvantage has been compensated for by the use of two furnaces at each casting machine; one melting furnace and one holding furnace for temperature stabilization. Liquid metal is then transferred from the melting furnace to the holding furnace by use of a siphon tube. The use of two furnaces is, however, more costly, and it still demands the transport of ingot pallets to each casting machine.

One solution to this problem is known from U.S. Pat. No. 4,635,706, which describes a molten metal handling system. This system is particularly useful for delivering high melting temperature metals in their molten state from a crucible to a casting machine. The essential elements of this metal handling system are a pump and heated conduits to carry the molten metal to the casting station. Optionally, two or more sources of molten metal can be linked together to provide a continuous source of metal to one or more die casting machines. However, the system is based on the use of electromagnetic pumps. This is unnecessarily complex and vulnerable. The patent gives no solution as to how the distribution to several casting machines should be performed. The direct connection of the transport tube to the metering unit does not give any flexibility with regard to the choice of metering system. In addition, the transport tubes are situated above the melt level in the furnace. This is unfortunate with regard to safety in the case of an eventual run-out of magnesium.

SUMMARY OF THE INVENTION

The object of the invention is to obtain a safe and flexible distribution system for molten magnesium and magnesium alloys. Another object is to obtain a system that is reliable in service and that delivers metal of high quality at a correct casting temperature.

These and other objects of the invention are achieved by the process and apparatus described below, and the invention is characterized and defined by the accompanying patent claims.

The invention relates to an apparatus for the distribution of magnesium or magnesium alloys from a central melting unit to a foundry with one or more casting machines. A tube furnace is arranged from the central melting unit and into the casting shop. The use of a central melting unit ensures uniform temperature of the metal to the casting machines. The tube furnace is equipped with outlets at the top for the mounting of transfer tubes for the supply of metal to one or more holding furnaces arranged at each casting machine. Preferably the tube furnace is positioned just beneath the metal level in the furnaces. The molten magnesium or magnesium alloy is transferred from the central melting unit to the tube furnace and further to one or more holding furnaces through transfer tubes by gravity.

The tube furnace and transfer tubes are equipped with heating elements and an outer insulation zone. The transfer tube has an air inlet for emergency stop. A steel cover surrounds the tube furnace. It is also possible to place two or more tube furnaces in the steel cover.

BRIEF DESCRIPTION OF THE DRAWINGS

The invention is further described and exemplified with reference to drawing FIGS. 1–2, where.

DETAILED DESCRIPTION OF THE PREFERRED EMBODIMENT

The invention utilizes the advantage that molten magnesium does not attack selected steel materials and the possibility of heating steel tubes of these materials with electrical resistance windings.

Figure 1:
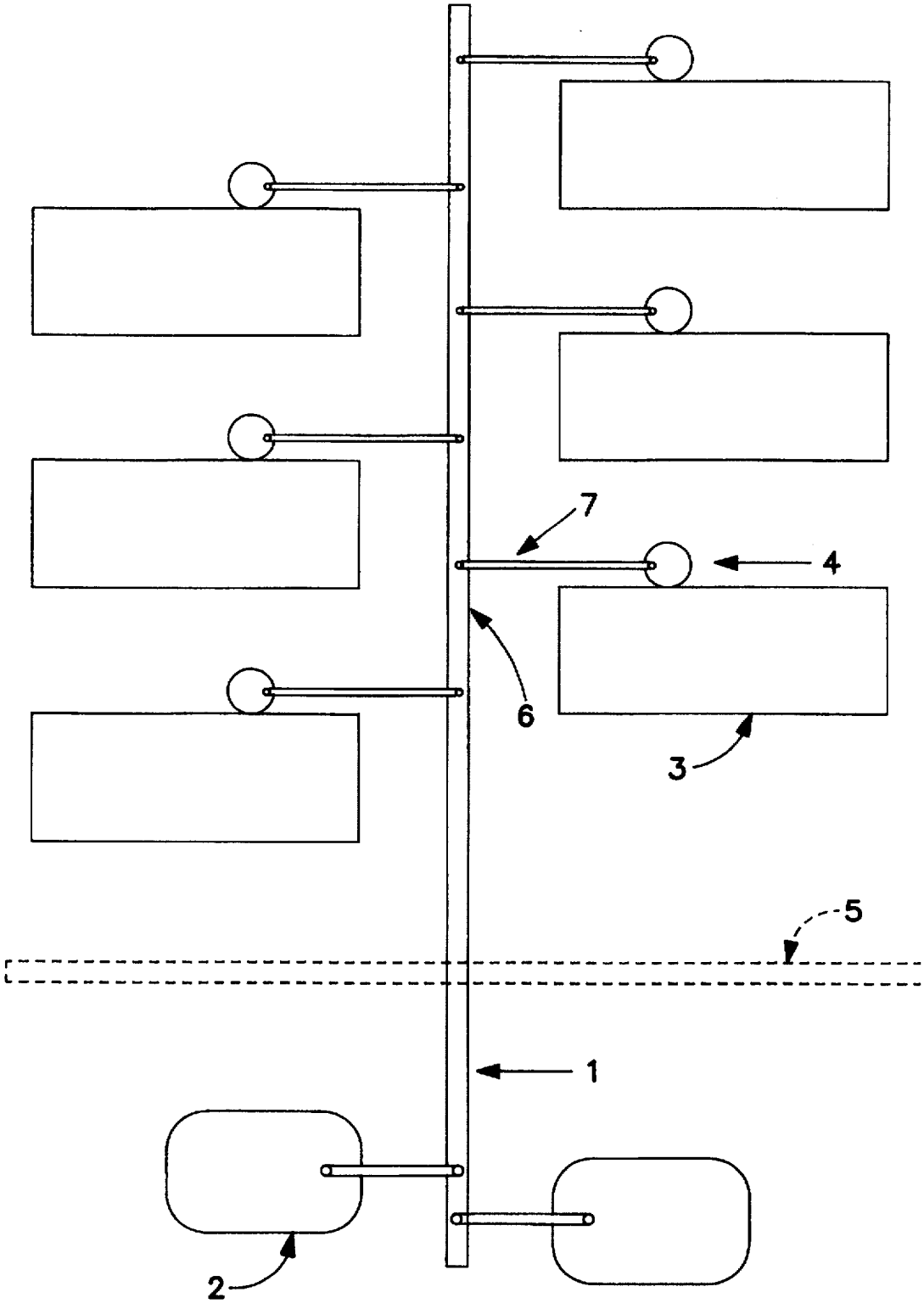
FIG. 1 shows a schematic view of the distribution system.

As shown in FIG. 1, a distribution system consists of a tube furnace 1 stretching from a central melting unit 2 and into a casting shop having several casting machines 3 which are to be fed with liquid metal. The length and shape of the tube furnace will be dependent on the number of casting machines and the design of the casting shop. Each casting machine is provided with a holding furnace 4 containing a metering unit (not shown) supplying the machine. The central melting unit 2 can be located in a facility separated from the casting machines by a wall 5. In the figure two melting units are shown connected to the tube furnace 1.

The tube furnace 1 is positioned just beneath the metal level in the furnaces and is equipped with outlets 6 on its top at regular intervals. At each outlet 6 can be mounted a transfer tube 7, ensuring transfer of metal from the tube furnace to the holding furnace 4 by the act of gravity. In the same way, metal is transferred from the central melting furnace(s) to the tube furnace by similar transfer tubes utilizing the act of gravity.

By this design the distribution of the molten alloy from the central melting unit to each casting machine will take place fully automatically since the act of gravity will ensure equal level in each of the furnaces combined in the network. Also, any kind of valves that would be vulnerable to mechanical wear are avoided. Metal needs to be melted at the same rate as the total consumption in the network. This can be ensured by a level detector in the melting furnace controlling the feed of metal to the furnace.

Figure 2:
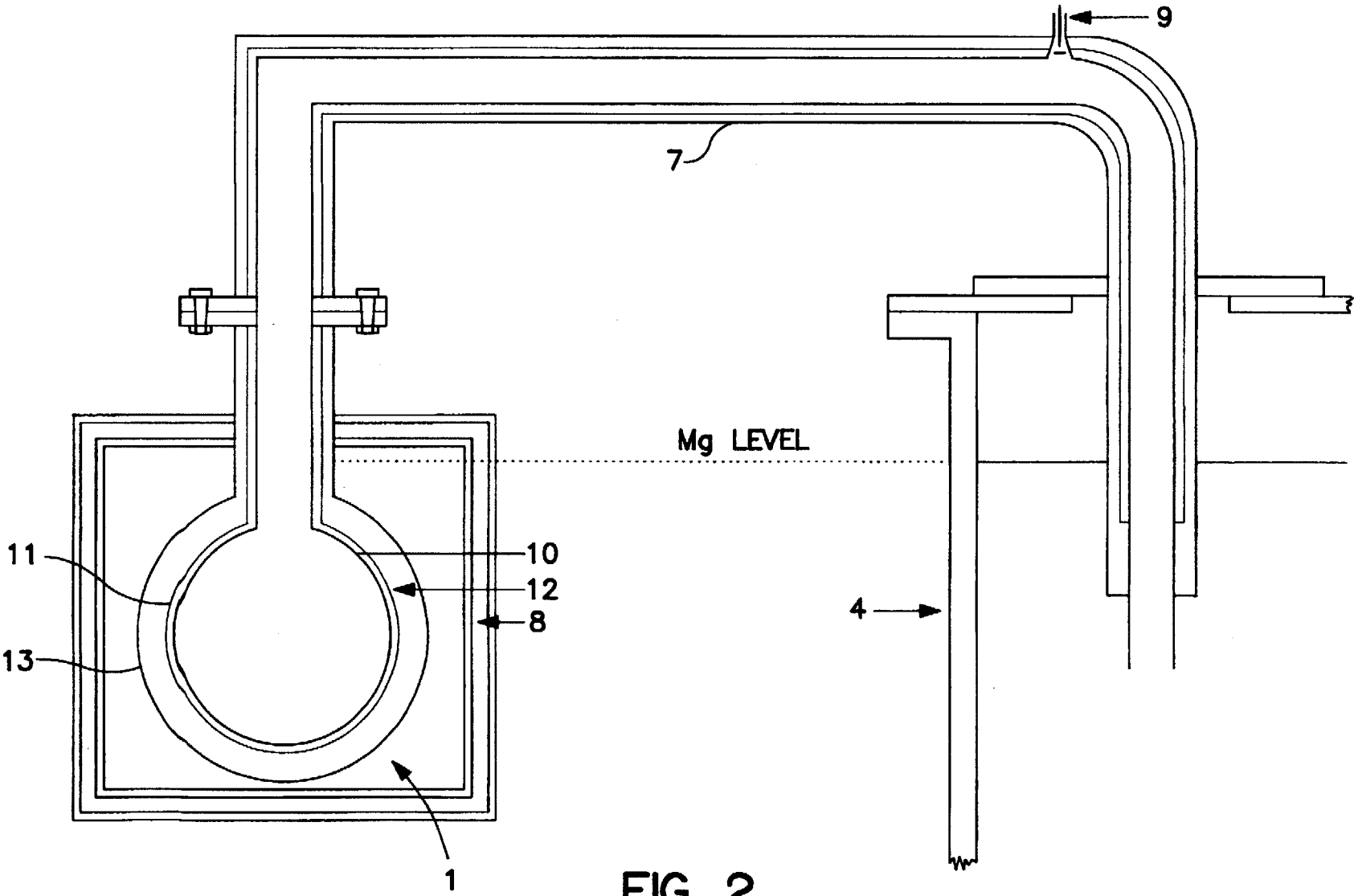
FIG. 2 shows a cross section of the tube furnace and transfer tube.

The tube furnace 1 and transfer tube 7 are shown in more detail in FIG. 2. For security reasons the tube furnace 1 is placed inside an insulated steel cover 8 that would hold the total amount of metal in the tube furnace 1 and the transfer tube 7 in case of an outbreak from the tube furnace 1. Also, each transfer tube 7 is equipped with an emergency stop that comprises an inlet for air 9 on top of the tube 7 and thereby empties it and prevents any further transfer between the tube furnace and the melting/holding furnaces.

The tube furnace 1 and transfer tube 7 have an inner steel tube 10 which is wound with a heating element 11. A centrally located thermocouple (not shown) is provided for temperature regulation. This system is then provided with a thin stainless steel foil, to keep the heating elements in place and contribute to uniformity of heating. The inner pipe is insulated with insulation 12 and has an outer mantle 13.

One important aspect with the design is that, apart from the melting and holding furnaces, the molten alloy has no surface towards the atmosphere. Such open surfaces would need protection against metal oxidation and would also be vulnerable for contamination of the melt through oxide formation.

As an example, a system is designed for feeding six casting machines with a capacity of 500 kg/hour each. The total melting capacity will be 3000 kg/hour. In order to distribute this amount over a distance of 50 m, a tube furnace with an inner diameter of 150 mm is needed, whereas each of the transfer tubes would need an inner diameter of 38 mm in order to transfer the amount of 500 kg/hour over a distance of 3 m. These dimensions will be sufficient to avoid level differences to build up between the melting furnace(s) and the holding furnaces.

Start-up of the distribution system would include melting of initial metal in the melting and holding furnaces followed by heating of the tube furnace and filling it with liquid alloy to the same level as the furnaces. Eventually, if the tube furnace already contained solid metal, this would have to be melted. Transfer tubes prefilled with solid metal could then be mounted and heated. As soon as the metal in the transfer tube is melted, transfer of metal to the holding furnace begins. If, for any reason, one or more of the casting machines in the network should be taken out of service, the transfer tubes connecting these machines to the network could be solidified and/or removed from service. At longer operation stops, for instance over week ends, the metal in the whole distribution system could be solidified.

As a backup system, two or more tube furnaces may be located side by side in the same cover box. This would also give the possibility of casting different alloys on the network. For the same reasons, several melting furnaces should be available in the melting shop, with possibilities of connecting to either of the tube furnaces. The melting shop could even include refining furnaces for the recycling of scrap that could be directly attached to the network.

The system is also suitable for casting of other metals, for example zinc.

We claim:

1. An apparatus comprising:

a central melting unit;

a casting shop having at least one casting machine;

at least one holding furnace arranged at said at least one casting machine, respectively;

a tube furnace extending from said central melting unit into said casting shop, said tube furnace comprising at least one outlet; and at least one transfer tube extending from said at least one outlet to said at least one holding furnace;

wherein said tube furnace and said at least one outlet are arranged with respect to said at least one transfer tube and said at least one holding furnace such that metal can be supplied from said central melting unit to said at least one holding furnace by the act of gravity.

2. The apparatus of claim 1, wherein said at least one outlet are situated on the top of said tube furnace.

3. The apparatus of claim 1, wherein each said at least one holding furnace has a designated metal level at which molten metal is to be maintained during operation, and said tube furnace is disposed below said metal level.

4. The apparatus of claim 1, wherein said tube furnace and each said at least one transfer tube comprise heating elements and outer insulation thereon.

5. The apparatus of claim 1, wherein said each said at least one transfer tube comprises an air inlet.

6. The apparatus of claim 1, wherein said tube furnace is disposed inside a steel cover.

7. The apparatus of claim 6, and further comprising a second tube furnace extending from a second central melting unit to said at least one holding furnace, said second tube furnace being disposed inside said steel cover.

8. An apparatus comprising:

a casting shop having at least one casting machine;

at least one holding furnace arranged at said at least one casting machine, respectively;

at least two tube furnaces extending into said casting shop to said at least one casting machine; and a steel cover surrounding said at least two tube furnaces.

9. A method of distributing molten magnesium or magnesium alloy from a central melting unit into a casting shop having one or more casting machines, comprising transferring molten magnesium or magnesium alloy from the central melting unit to a tube furnace and further to one or more holding furnaces through transfer tubes by the act of gravity.

10. The method of claim 9, and further comprising emptying the transfer tubes by letting air into the transfer tubes.

11. An apparatus for distribution of magnesium or magnesium alloys, comprising:

a central melting unit;

a casting shop having a plurality of casting machines;

a plurality of holding furnaces arranged at said casting machines;

a tube furnace extending from said central melting unit into said casting shop, said tube furnace comprising a plurality of outlets; and transfer tubes extending from outlets to said holding furnaces;

wherein said tube furnace, said outlets, said transfer tubes and said holding furnaces are arranged to as to together define a means for supplying magnesium or magnesium alloys from said central melting unit to said at least one holding furnace by the force of gravity.

* * * * *